US006575062B2

(12) United States Patent
Hahn

(10) Patent No.: US 6,575,062 B2
(45) Date of Patent: Jun. 10, 2003

(54) ACCOMMODATING HEAD FOR A TOOL WITH AN ACTUATING TIP

(75) Inventor: Wilfried Hahn, Schonach (DE)

(73) Assignee: Wiha Werkzeuge, Willi Hahn GmbH & Co. KG (DE)

( * ) Notice: Subject to any disclaimer, the term of this patent is extended or adjusted under 35 U.S.C. 154(b) by 0 days.

(21) Appl. No.: 09/864,624

(22) Filed: May 24, 2001

(65) Prior Publication Data

US 2002/0007704 A1 Jan. 24, 2002

(30) Foreign Application Priority Data

May 24, 2000 (DE) ..... 200 09 358

(51) Int. Cl.[7] ..... B25B 23/00
(52) U.S. Cl. ..... 81/460; 81/177.75
(58) Field of Search ..... 81/460, 440, 64, 81/177.75, 177.6; 464/106, 158, 159, 905

(56) References Cited

U.S. PATENT DOCUMENTS

| | | | | | |
|---|---|---|---|---|---|
| 3,897,703 | A | * | 8/1975 | Phipps | 81/177.75 |
| 4,084,478 | A | * | 4/1978 | Simmons | 411/404 |
| 4,436,005 | A | * | 3/1984 | Hanson | 81/177.75 |
| 4,824,418 | A | * | 4/1989 | Taubert | 464/159 |
| 4,833,950 | A | * | 5/1989 | Moncada | 81/177.75 |
| 5,007,880 | A | * | 4/1991 | Walker | 464/159 |
| 5,069,569 | A | * | 12/1991 | Lieser | 403/57 |
| 5,251,521 | A | * | 10/1993 | Burda et al. | 81/460 |
| 5,370,021 | A | * | 12/1994 | Shigematsu | 81/436 |
| 5,408,905 | A | * | 4/1995 | Mikic et al. | 81/460 |
| 5,738,586 | A | | 4/1998 | Arriaga | 464/106 |
| 5,797,918 | A | | 8/1998 | McGuire et al. | 606/104 |
| 6,105,473 | A | * | 8/2000 | Huang | 81/177.75 |
| 6,152,826 | A | * | 11/2000 | Profeta et al. | 464/159 |

FOREIGN PATENT DOCUMENTS

| | | |
|---|---|---|
| DE | 827780 | 1/1952 |
| DE | 20008360 | 9/2000 |
| EP | 0308968 | 3/1989 |

OTHER PUBLICATIONS 0 308 968, Rittmann et al. , Off–axis bit or the like., Mar. 29, 1989, entire document.*

* cited by examiner

*Primary Examiner*—Lee D. Wilson
*Assistant Examiner*—David B. Thomas
(74) *Attorney, Agent, or Firm*—Ostrolenk, Faber, Gerb & Soffen, LLP

(57) ABSTRACT

An accommodating head for a tool which has an actuating tip and is intended for turning fastening elements, the tool having a drive element and an output element, it being possible for a torque to be introduced into the drive element and the tool being arranged in a rotationally fixed and pivotably mounted manner in the output element. In torque transmission from the actuating tip to the fastening element, the distance between the pivot axis of the actuating tip of the tool and the fastening element is small enough for the line of action of a force running along a longitudinal center axis of the output element to intersect the fastening element even in each pivoting end position of the tool and the actuating tip thereof.

25 Claims, 5 Drawing Sheets

ACCOMMODATING HEAD FOR A TOOL WITH AN ACTUATING TIP

BACKGROUND OF THE INVENTION

The invention relates to an accommodating head for a tool with an actuating tip which pivots to the element receiving the actuating tip.

Tools with a slot-type tip or polygonal tip are known. They serve for rotating fastening elements, in particular screws. The actuating tip here is designed, depending on the accommodating contour on the fastening element, as a correspondingly shaped slot-type actuating tip, in particular a cross-slot-type actuating tip. Examples of the polygonal actuating tips are so-called socket actuating or Torx actuating tips. When use is made of these tools or actuating tools with these actuating tips, it is not always ensured, in particular in the case of hand-actuated or hand-guided actuating tools, that the longitudinal axis of the actuating tool is in alignment with the longitudinal axis of the fastening element, that is to say, for example of the screw. In the case of a torque transmission from the actuating trip to the screw, a skewed position of the actuating tool may thus result in the actuating tip being forced out of the corresponding accommodating contour on the screw. This may result in damage to the screw head, with the result that subsequent operations for tightening or releasing the screw are not possible. The actuating tools are either hand-actuated tools, for example screwdrivers or the like, or hand-guided tools with a drive motor, in particular battery-powered screwdrivers. Provision may be made for the screwdriver to be formed integrally with the actuating tip. It is also possible, however, to provide on the screwdriver an accommodating head into which the actuating tip can be plugged. In this case, the accommodating head is designed, in particular, as a so-called bit mount and the actuating tip is designed as a bit. Such a configuration may also be provided in the case of the hand-guided actuating tools.

The abovementioned type of accommodating head for a tool with a slot-type or polygonal actuating tip has a drive element and an output element, it being possible for a torque to be introduced into the drive element, and the actuating tip being arranged in the output element. The rotational forces applied by the actuating tool are introduced into the drive element, with the result that, on the output side, the actuating tip can be subjected to a torque in order for it to be possible for the fastening element to be screwed into a mount or unscrewed therefrom. The tool which has the actuating tip may be mounted pivotably in the output element. It is thus possible to ensure, even in the case of a skewed position of the actuating tool in relation to the fastening element, that the actuating tip engages in a mount of the fastening element, such that the longitudinal center axes of the actuating tips and of the fastening element are in alignment with one another. The disadvantage here is that, with the actuating tip pivoted, a tilting moment is produced on account of the axial force which is to be applied to the actuating tool when the fastening element is screwed in or unscrewed, it being possible for said tilting moment to result in the actuating tip slipping out of the cutout on the fastening element.

SUMMARY OF THE INVENTION

The object of the invention is to specify an accommodating head for a tool with an actuating tip in which there is at least a reduction in the risk of the tool being forced out of the fastening element in the case of an alignment error of the longitudinal center axes of the accommodating head and of the fastening element.

This object is achieved by an accommodating head which has the features specified in claim 1. The accommodating head serves for accommodating a tool with an actuating tip, for example, a slot-type or polygonal actuating tip. The accommodating head has a drive element and an output element, it being possible for a torque to be introduced into the drive element by means of an actuating tool. The tool which has the actuating tip is arranged in a rotationally fixed and pivotably mounted manner in the output element. Suitable torque-transmission means are provided between the output element and the actuating tip in order for it to be possible for the torque applied by the actuating tool to be introduced into the actuating tip. The accommodating head is distinguished in that, in the case of a torque transmission from the actuating tip to the fastening element, the distance between the pivot axis of the actuating tip in the output element and the fastening element is small enough for the line of action of a force running along a longitudinal center axis of the output element or of the accommodating head to intersect the fastening element even in each pivot end position of the actuating tip, that is to say that, in this position of the actuating tip, the line of action runs through the fastening element. With the actuating tip plugged into the corresponding cutout on the fastening element, the pivot axis of said actuating tip is arranged at a very small distance from the fastening element, for example, the head of a screw, in which the cutout for accommodating the actuating tip is located. Since, on account of the configuration of the accommodating head according to the invention, the axial force which is applied to the actuating tool when the fastening element is screwed in and unscrewed, and acts in the direction of the longitudinal center axis of the output element, is always introduced into the fastening element in each pivot position of the actuating tip, it is ensured that the actuating tip is forced into the cutout on the fastening element and a tilting moment is not produced—as in the case of known accommodating heads—it being possible for said tilting moment to result in the actuating tip being forced out of the cutout.

The accommodating head according to the invention makes it possible for the actuating tip to be arranged or plugged in an accurately fitting manner in the corresponding cutout on the fastening element although the actuating tool provided for the torque application can be pivoted within an admissible range.

Another advantageous factor with the pivot mounting of the actuating tip is that it is possible to screw in or unscrew even poorly accessible screws located, for example, behind an obstruction. It is also advantageous here that there is no narrowing in the region of the actuating tip, as is albeit necessary in the case of spherical-head hexagon wrenches in order to allow pivoting of the spherical-head hexagon wrench relative to the fastening element. The weak point of the narrowing is done away with in the case of the tool according to the invention. This makes it possible for the torque which is to be transmitted to be very large in the case of the tool according to the invention.

On account of the pivotable mounting of the actuating tip, it is also possible for latter to be designed as a special profile, for example XZN, TorxPlus, TorxTR, TriWing, Torq, etc., in the case of which pivot mounting has not been known at all up until now. It is also advantageous that the multi-part construction allows optimal selection of the materials used for the accommodating head and the actuating tip. It is thus possible, for example, in a particularly advantageous configuration, for the actuating tip to be produced from a very high-grade material, such as solid hard metal, ceramic material or coated steel, whereas the accommodating head could be produced from some other, less expensive material. It is thus nevertheless possible for a high-grade actuating tool to be produced cost-effectively.

A preferred exemplary embodiment is distinguished in that, at its output end, the actuating tip has a sphere section which is mounted pivotably in a sphere-section mount formed on the output element. The ability of the actuating tip to pivot may thus be realized easily and cost-effectively.

A particularly advantageous exemplary embodiment of the accommodating head provides that the distance X between the pivot axis of the tool/of the actuating tip in the output element and the fastening element is equal to or smaller than the radius of the sphere section. The tool is thus only of short length.

A preferred exemplary embodiment is one in which the sphere section of the actuating tip is retained in captive fashion in the sphere-section mount of the accommodating head. This may be achieved, for example, by a rear-engagement means which grips round the sphere section such that the latter cannot slip out of the sphere-section mount. This may be achieved, for example, in that the edges of the sphere-section mount are deformed following insertion of the sphere section.

In a particularly preferred exemplary embodiment, first and second torque-transmission means are provided between the output element and the tool, the first torque-transmission means being formed by flattened regions on the outer surface of the sphere section. The sphere section is thus realized as a polygonal-sphere section. The second torque-transmission means are formed in that the sphere-section mount is a cylindrical cutout which is designed as a polygonal cutout in cross section. The torque transmission may thus take place between the surfaces or walls of the polygonal cutout and the flattened regions on the outer surface of the sphere.

In a preferred exemplary embodiment the slot-type or polygonal actuating tip directly adjoins the cut surface of the sphere section. "Cut surface" is to be understood here as meaning the flattened portion, that is to say the planar surface, of the sphere section. The actuating tip is, as it were, positioned on said flattened portion or juts out from the same. The important factor is for the point of rotation or the pivot axis of the actuating tip to be located at only a very small distance from the fastening element which is to be screwed in or unscrewed. This reduces the risk of a tilting moment being produced in the case of a non-axially-introduced force, where a tilting moment could result in the actuating tip slipping out of the fastening element. By virtue of this arrangement, the pivot mounting according to the invention also differs considerably from a universal joint known per se.

In a preferred exemplary embodiment, a pivoting-angle-limiting means is formed between the actuating tip and the accommodating head and is preferably formed by a pivoting-angle-limiting projection extending from the outer surface of the sphere section, said projection extending from the outer surface of the sphere in the opposite direction to the slot-type or polygonal actuating tip. With a corresponding pivoting angle between the actuating tip and accommodating head, the pivoting-angle-limiting projection comes into contact with the inner wall of the sphere section mount and thus limits the pivoting angle in a straightforward manner. This also, however, prevents the actuating tool from tilting excessively, since the pivoting angle cannot become inadmissibly large. Furthermore—starting from a preferred starting position—the at least one pivot end position of the actuating tip is established or defined.

In a particularly preferred exemplary embodiment, a pivot-restoring element is formed between the actuating tip and the output element. When the actuating tip is not subjected to loading, it may thus be pivoted back into its starting position. In this case, the center longitudinal axis of the actuating tip is in alignment with the center longitudinal axis of the accommodating head or of the output element.

For the pivot restoring element, use is preferably made of an elastic element which acts on the pivoting-angle-limiting projection on the sphere section. This means that the actuating tip can easily be restored into its starting position.

In one exemplary embodiment, the drive element is defined as a shank mount in which the shank of a drive device of an actuating tool engages. Of course, however, it is also possible for the accommodating head and the shank of the drive device of the actuating tool to be formed in one piece.

In another exemplary embodiment, the shank mount and the shank of the actuating tool are fixed to one another. In a further exemplary embodiment, the shank mount may be designed as a plug-connection mount which accommodates the shank of the drive device in a releasable manner. The accommodating head may thus also be designed for plug connection, with the result that different accommodating heads with different actuating tips can be used with a single shank or a single drive device. As a result, the accommodating head and the actuating tip form a structural unit, which, in turn, may be provided as a so-called bit.

A particularly preferred exemplary embodiment is the one in which the shank mount and the sphere-section mount are formed in a sleeve. The shank thus engages in one end of the sleeve, and the actuating tip is plugged into the other end of the sleeve.

A preferred exemplary embodiment is one in which the sphere-section mount and the shank mount are formed in the sleeve by a through-passage in the sleeve, the through-passage having a polygonal cross section. The number of edges of the polygonal cross section, however, may differ between the sphere-section mount and the shank mount.

Also preferred is an exemplary embodiment in which the shank of the drive element has a cutout which extends in the axial direction of the shank and in which the pivoting-angle-limiting projection engages. By virtue of the selection of the cross section of this cutout, which may, for example, be smaller than that of the cutout for the actuating tip, it is possible for the pivoting-angle range to be adjusted correspondingly since, depending on the extent of the cutout, the pivoting-angle-limiting projection comes into contact with the wall of the cutout with a larger or smaller pivoting angle of the actuating tip.

Further configurations can be gathered from the subclaims.

The subject matter of the invention also relates to a hand-actuatable or hand-guided turning tool which comprises an accommodating head for accommodating a tool which has an actuating tip.

BRIEF DESCRIPTION OF THE DRAWINGS

The invention is explained in more detail hereinbelow by way of exemplary embodiments and with reference to the drawing, in which.

DESCRIPTION OF PREFERRED EMBODIMENTS

Figure 1:
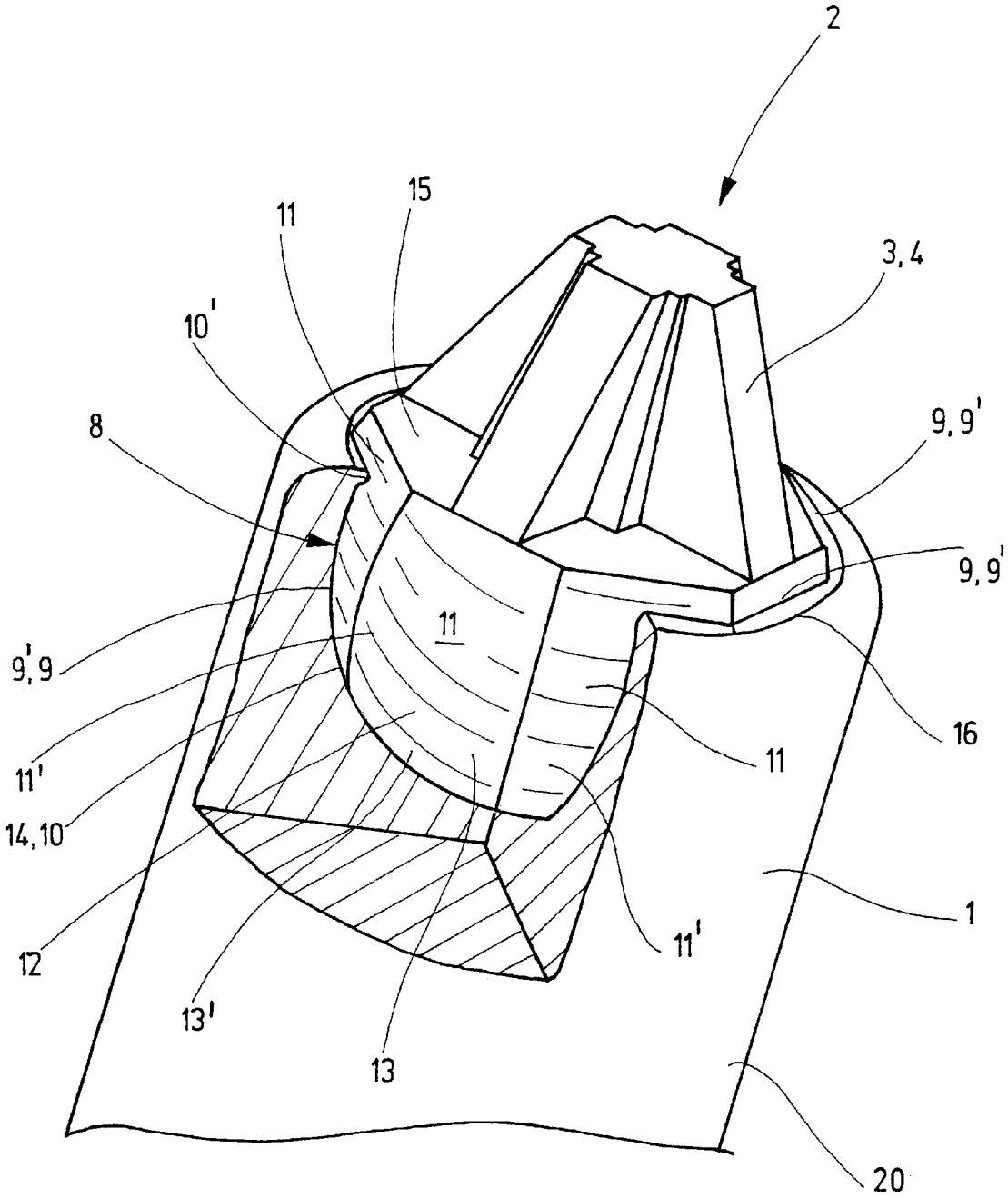
FIG. 1 shows a perspective view, partly in section, of a first exemplary embodiment of an accommodating head with a pivotably mounted actuating tip, FIGS. 2A and 2B each show a perspective view of a further exemplary embodiment of an actuating tip, FIGS. 3A and 3B each show a perspective view of a further exemplary embodiment of an actuating tip.
Figure 2A:
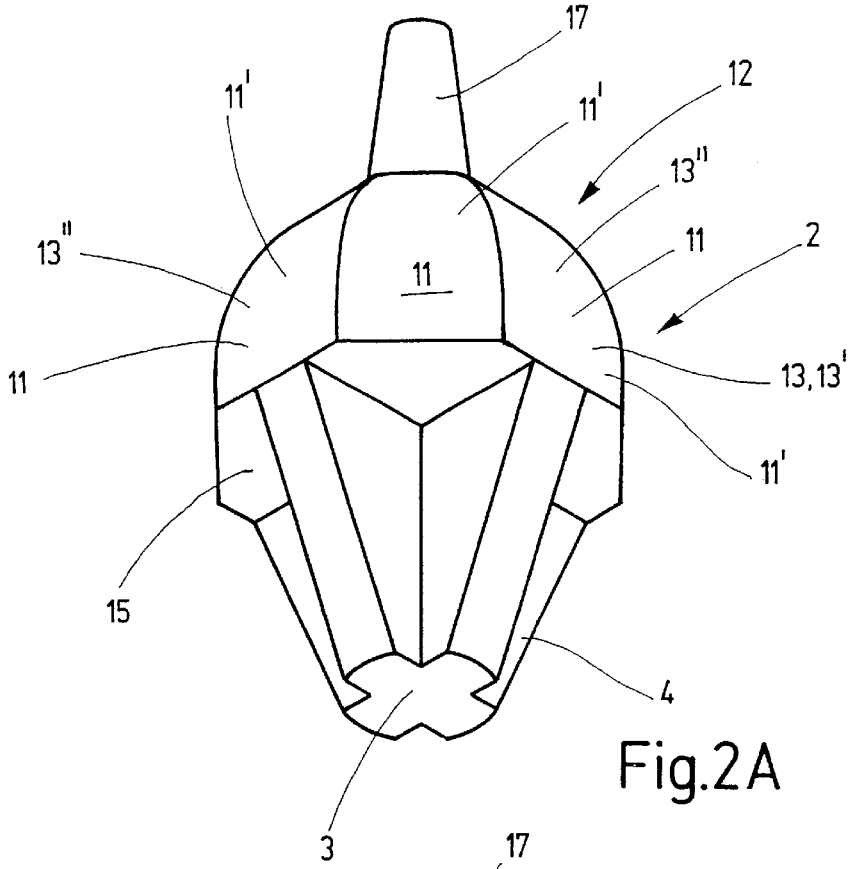
Figure 3A:
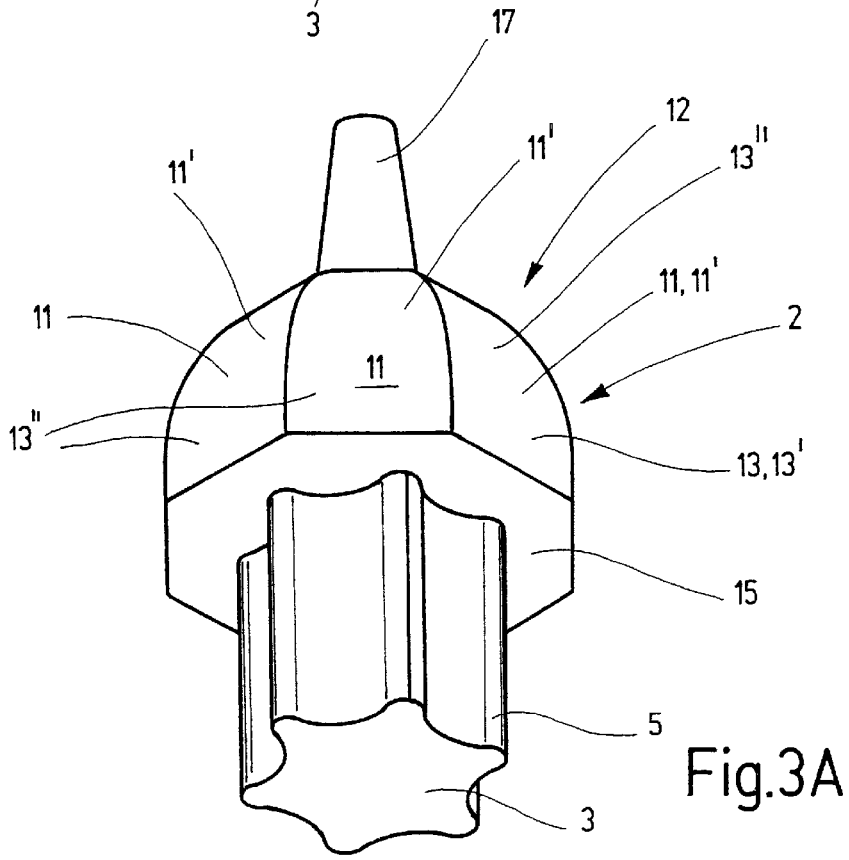

FIG. 1 shows part of an accommodating head 1 for a tool 2 which has an actuating tip 3. The actuating tip 3 may be designed as a slot-type actuating tip 4 (FIG. 2), in particular cross-slot-type actuating tip, or as a polygonal actuating tip 5 (FIG. 3), in particular as a Torx or the like. The polygonal actuating tip 5 is preferably a polygonal stub. Common to all the variants of the actuating tip 3 is the fact that they can be plugged into a cutout provided on a fastening element specifically for this purpose. The shape of the cutout is usually adapted to the outer contour of the actuating tip 3.

The accommodating head 1 has a drive element 6 (FIG. 5) into which a drive torque (arrow 6') can be introduced by a drive device 7 of a hand-guided or hand-driven actuating tool (not illustrated here). On the output side, the accommodating head 1 has an output element 8, by means of which the torque applied by the actuating tool is transmitted to the tool 2. Between the tool 2 and the output element 8, the torque transmission is ensured by first and second torque-transmission means, the first torque-transmission means 9 forming wall surfaces 9' of a cylindrical cutout 10 which is of polygonal design in cross section. Second torque-transmission means 11 butt against the first torque-transmission means 9, that is to say against the wall surfaces 9' of the cutout 10, and are formed by flattened regions 11' on the outer surface 12 of a sphere section 13 of the tool 2. Since the tool 2 has the sphere section 13, which is accommodated, in particular in captive fashion, in the cutout 10, the actuating tip 3 is designed such that it can be pivoted in relation to the output element 8 or the accommodating head 1. The cutout 10 is thus preferably realized as a sphere-section mount 14 in which the sphere section 13 is mounted such that, in accordance with the number of first and second torque-transmission means, it can be pivoted about a corresponding number of axes. It can be seen that the sphere section 13 is realized as a polygonal-sphere section 13', of which the polygonal surfaces 13" form the second torque-transmission means 11.

It can be seen from FIG. 1, which shows a perspective view, partly in section, of the accommodating head, that the cutout 10 is adapted to the outer surface 12 of the sphere. In particular, the greatest depth of the cutout 10 is realized such that the polygonal-sphere section 13' is accommodated essentially in its entirety, and merely the actuating tip 3 projects beyond the accommodating head 1, that is to say the end side of the latter. It can be seen that the tool 2 is formed by the polygonal-sphere section 13' and the actuating tip 3, the actuating tip 3 adjoining the cut surface 15 of the polygonal-sphere section 13'. In order for it to be possible for the tool 2 to be retained in captive fashion in the accommodating head 1, provision is made, following the insertion of the polygonal-sphere section 13' into the cutout 10, for the mouth-region-forming edge 16 of the accommodating head 1 to be deformed, for example, to be flanged or forced over, with the result that it is no longer possible for the polygonal-sphere section 13' to slip out of the cutout 10. A loss-prevention means 10' is thus formed on the output element 8.

Figure 5:
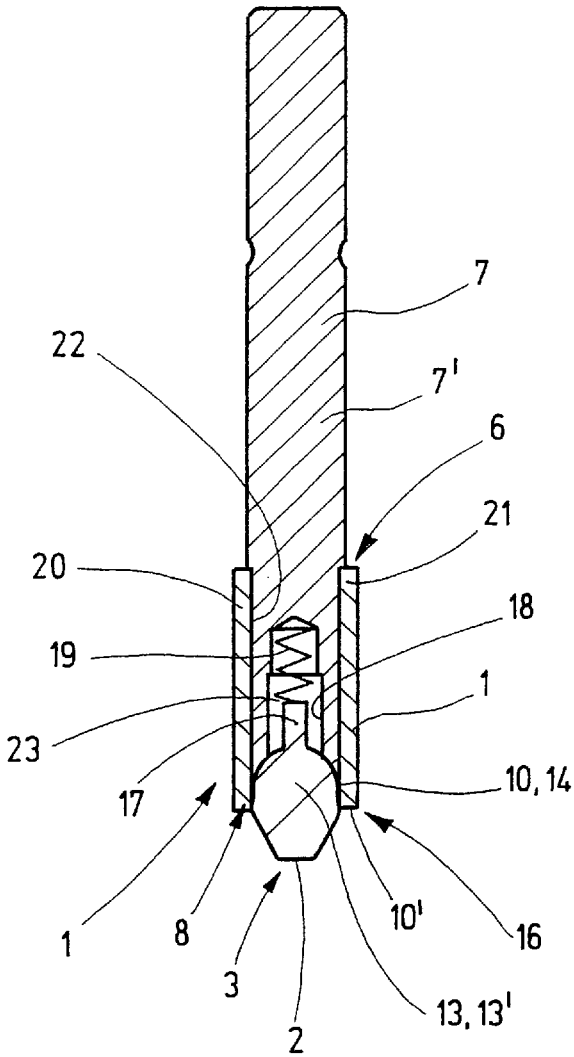

FIGS. 2A, 2B, 3A and 3B each illustrate a perspective view of an exemplary embodiment of a tool 2. Parts which are the same, or act in the same way, as in FIG. 1 are provided with the same designations, for which reason you are referred to the description thereof. It can be seen from the FIGS. 2A, 2B, 3A and 3B that a pivoting-angle-limiting projection 17 extends from the outer surface 12 of the sphere, said projection extending in the opposite direction to the actuating tip 3. This pivoting-angle-limiting projection 17 engages in a sub-cutout 18 (FIG. 5), with the result that the pivoting angle of the actuating tip 3 is limited when the pivoting-angle-limiting projection 17 butts against a side wall of the sub-cutout 18. In order to allow the actuating tip 3 to be restored from a pivoting angle, a pivoting-angle-restoring element 19 (FIG. 5) is provided, said element preferably being designed as an elastic element and acting on the pivoting-angle-limiting projection 17. By way of one end, the pivot restoring element 19 thus interacts with the pivoting-angle-limiting projection 17 and with the drive device 7, as is illustrated in FIG. 5, or with the accommodating head 1. Provision is made, in particular, for the pivoting-angle-restoring element 19 to be clamped in between the pivoting-angle-limiting projection 17 and the drive device 7 or the accommodating head 1. It can be gathered from this that, when the tool 2 pivots, the pivot restoring element 19 is tensioned and, when the tool 2 is relieved of loading, this tensioning is transmitted to the pivoting-angle-limiting projection 17 in order thus to achieve a restoring action into a basic position (as is illustrated in FIG. 5). It is possible, in particular, for the pivot restoring element 19 to be realized as an elastic element, in particular as a helical spring, which acts on the pivoting-angle-limiting projection 17. It can be gathered from this that the sub-cutout 18 may be part of the polygonal cutout 10 on the accommodating head 1, with the result that the shank 7' of the drive device 7 and the accommodating head 1 are formed in one piece. It is also possible, however—as illustrated in FIG. 5—for the accommodating head 1 to be designed as a sleeve 20 in which the shank 7' of the drive device 7 engages. A preferred embodiment here is one in which the shank 7' and the shank mount 21, provided on the accommodating head 1, are fixed to one another. This can be achieved, for example, by forcing over the shank 7' and/or the sleeve 20. Provision may also be made, however, for the shank mount 21 to be designed as a plug-connection mount which accommodates the shank 7' of the drive device 7 in a releasable manner.

The accommodating head 1 is preferably formed by the sleeve 20, in the case of which the shank mount 21 and the sphere-section mount are formed by a through-passage 22 in the sleeve 20, said through-passage 22 having a polygonal cross section, with the result that it is possible for torque transmission to take place from the shank 7' to the accommodating head 1 and from the accommodating head 1 to the actuating tip 3 or tool 2.

Figure 4:
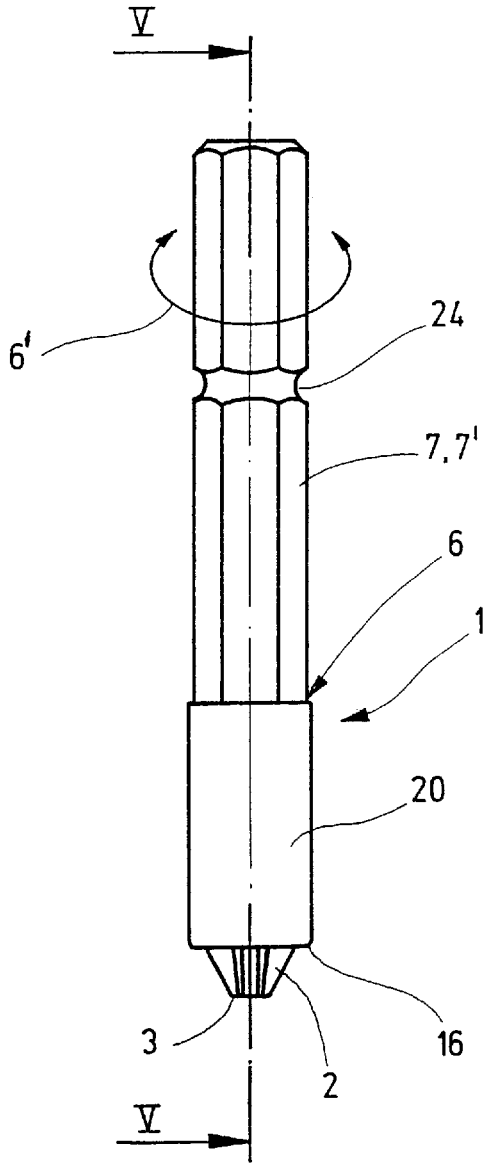
FIGS. 4 and 5 show a second exemplary embodiment of an accommodating head with a pivotably mounted actuating tip.

If the accommodating head 1, as is illustrated in FIGS. 4 and 5, is realized as a sleeve 20 which has been pushed more or less in its entirety onto the shank 7', a particularly preferred embodiment provides that the shank 7' has a cutout 23 which extends axially in it and in which the pivoting-angle-limiting projection 17 and preferably the pivoting-angle-restoring element 19 are positioned. The sub-cutout 18 is thus part of the cutout 23 in the shank 7'. It can be gathered from this, however, that it is also possible for the cutout 23 to be formed in the sleeve 20, with the result that the cutout 10 for the polygonal-sphere section 13' and the cutout 23 merge one into the other. It is thus possible to produce a joint cutout which is, for example, of step-like design, that is to say decreases in cross section in the direction of the shank 7'. It is not necessary, however, for the cutout 23 to have the same cross-sectional contour as the sphere-section mount 14. Rather, the cutout 23 is formed by an easy-to-produce bore since it is merely required to accommodate the pivoting-angle-limiting projection 17. It can be gathered from this that the cross section of the cutout 23 is larger than the cross section of the pivoting-angle-limiting projection 17, in order to allow the tool 2 to pivot.

It is, of course, possible for the actuating tool (not illustrated here) and the drive device 7 with its shank 7' to be formed in one piece. This configuration is preferred, in particular, in the case of screwdrivers. However, provision is also made for it to be possible for the shank 7' to be inserted into an actuating tool. In this case, in particular, it is provided that—at a distance from the accommodating head 1—a preferably encircling groove 24 is formed on the shank 7', a retaining means (not illustrated) of the actuating tool engaging in said groove. Of course, it is also possible for this retaining means to be formed on the shank 7' and for a corresponding groove to be formed on the actuating tool. Of course, it is possible for a wide range of different embodiments of accommodating heads 1 to be plugged onto the shank 7' with the result that the accommodating head 1 with its tool 2 retained therein is provided as a so-called bit which can be plugged onto the shank 7'. Here too, retaining means is also preferably provided between the accommodating head 1 and shank 7', said retaining means preventing unintentional release of the accommodating head 1 from the shank 7'.

Figure 2B:
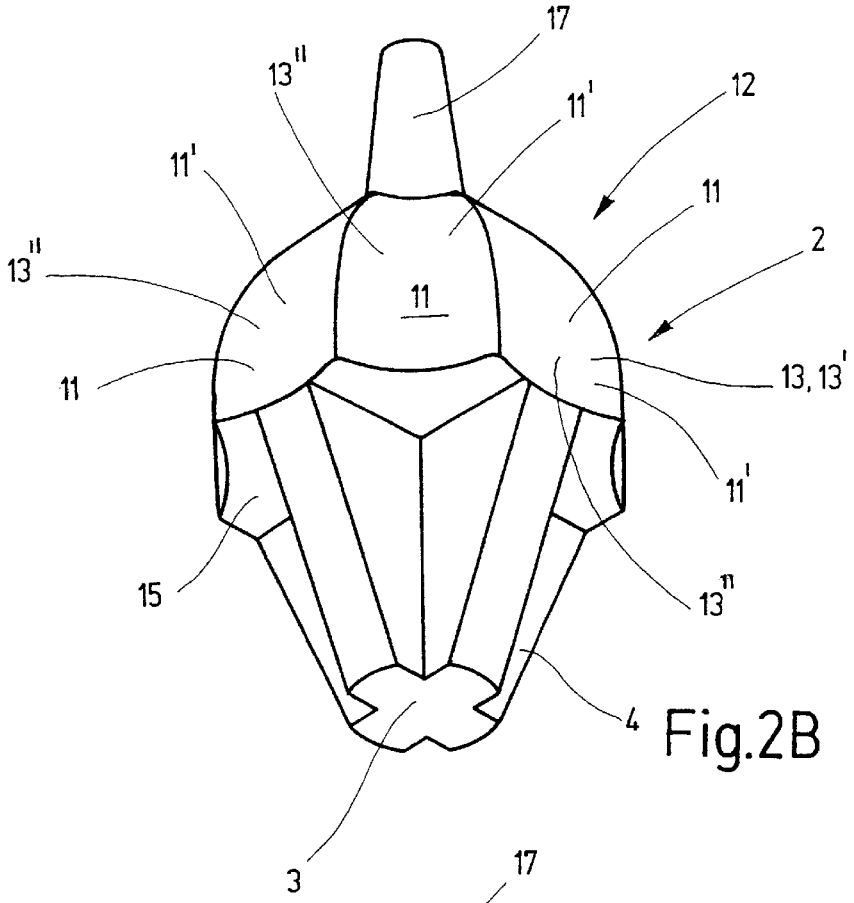
Figure 3B:
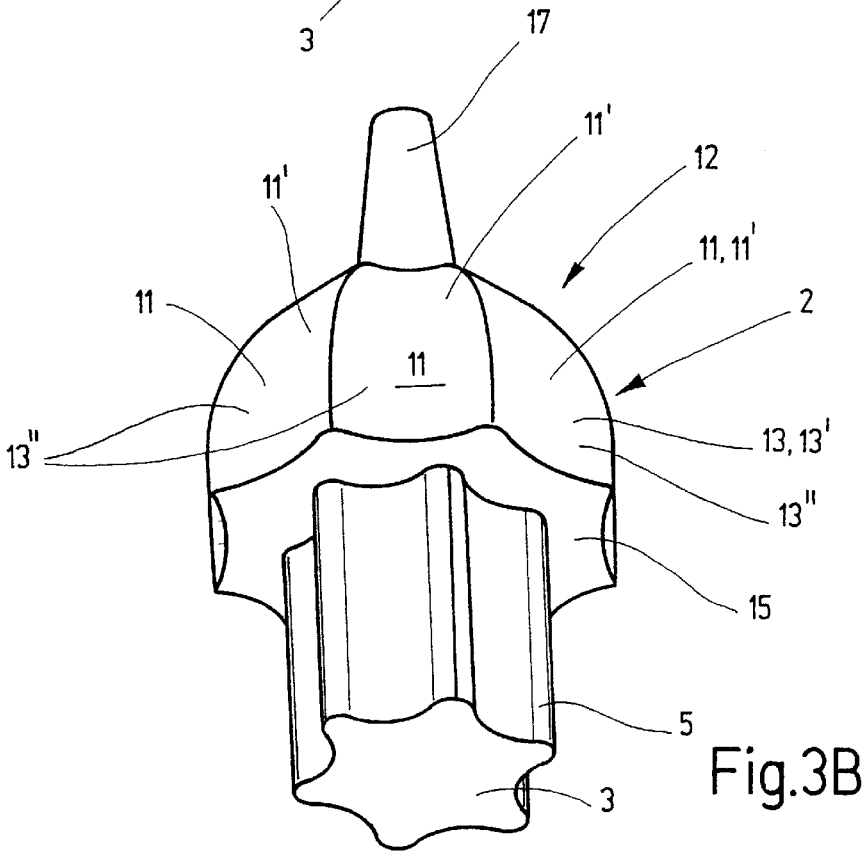

FIGS. 2B and 3B show an actuating tip 3 and a tool 2 in which the polygonal-sphere section 13' has polygonal surfaces 13" which, although following the contour of the outer surface 12 of the sphere in the axial direction, are curved inward in relation to the center point of the sphere. The polygonal outer surfaces 13" are thus curved outward corresponding to the outer surface 12 of the sphere, but have an additional, inwardly directed curvature. It can be gathered from this that this curved configuration of the polygonal outer surfaces 13" may also be provided for the tool 2 according to FIG. 1. If the polygonal outer surfaces 13", as is illustrated in FIGS. 2B and 3B, are curved inward, it may, of course, also be provided that the sphere-section mount 14 has correspondingly adapted first torque-transmission means 9'. This means that the wall surfaces 9' of the cutout 10 may be curved correspondingly outward, where their curvature adapted to the outer surface 12 of the sphere is additionally maintained. The wall surfaces 9' of the cutout 10 may thus also have a double curvature.

Figure 6:
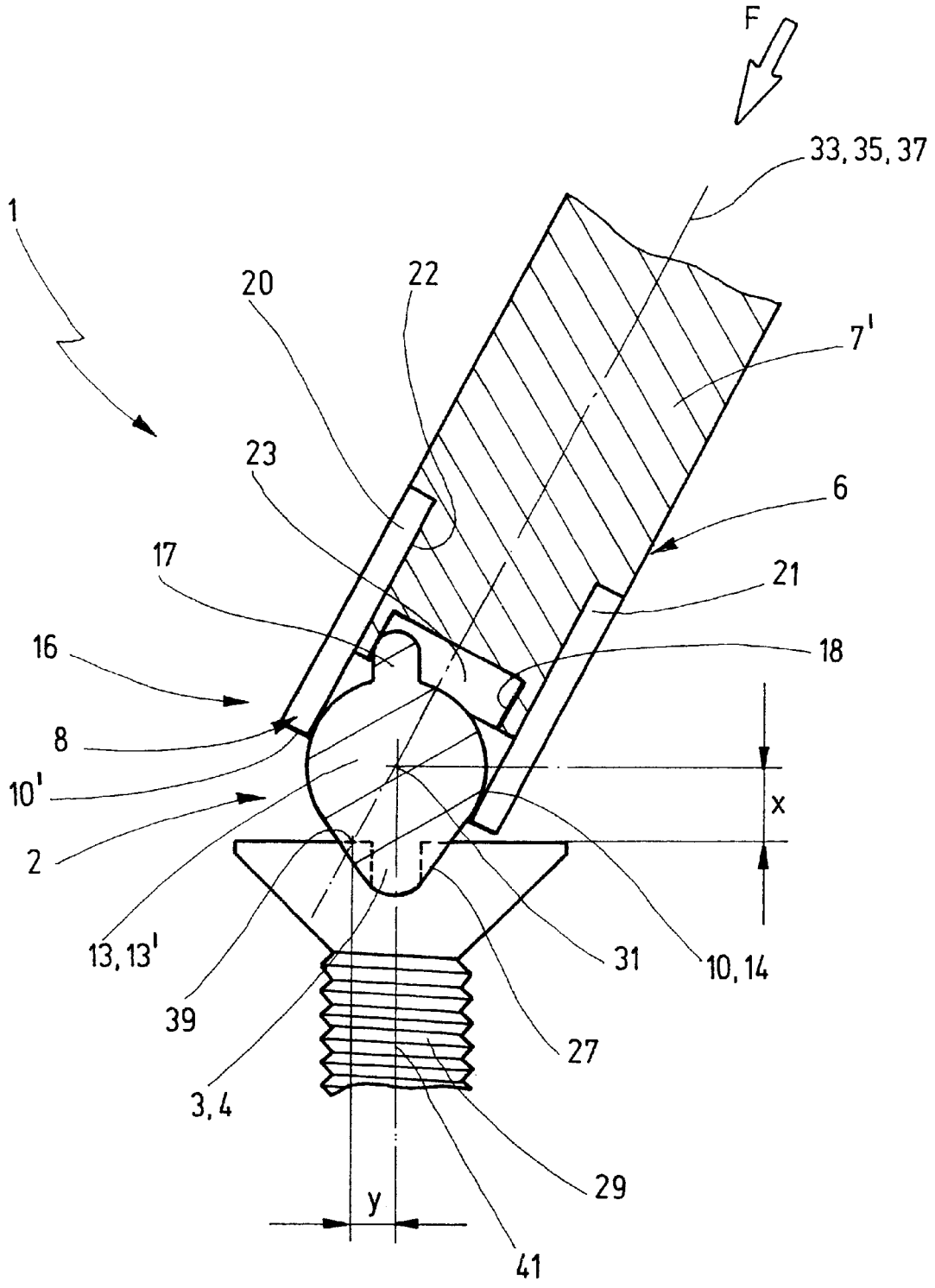
FIG. 6 shows, partly in section, a detail of a third exemplary embodiment of the accommodating head.

FIG. 6 shows a further exemplary embodiment of a highly schematically illustrated accommodating head 1 which is coupled to the drive device 7. The same parts are provided with the same designations, so, in this respect, you are referred to the description relating to the preceding figures. Between the tool 2 and the output element 8, the torque transmission is ensured by first and second torque-transmission means 9 and 11 (not illustrated in FIG. 6), the first torque-transmission means 9—as in the case, for example, of the exemplary embodiment described with reference to FIG. 1—forming wall surfaces 9' of a cylindrical cutout 10 which is of polygonal design in cross section. Second torque-transmission means 11 butt against the wall surfaces 9' of the cutout 10 and are formed by flattened regions 11' on the outer surface 12 of a sphere section 13 of the tool 2. Since the tool 2 has the sphere section 13, which is accommodated in the cutout 10 preferably realized as a sphere-section mount 14, the actuating tip 3 is designed such that it can be pivoted in relation to the output element 8 or the accommodating head 1. In this exemplary embodiment, the sphere section 13 is mounted such that, in accordance with a number of first and second torque-transmission means, it can be pivoted about a corresponding number of axes.

The tool 2 has a pivoting-angle-limiting projection 17 which extends from an outer surface 12 of the sphere and, with the tool 2 inserted into the accommodating head 1, engages in a sub-cutout 18. In order to realize a preferred position of the tool 2 or of the actuating tip 3 in relation to the accommodating head 1, it is possible to provide a pivoting-angle-restoring element 19 (not illustrated), as has been described with reference to FIG. 5.

The tool 2, retained in the accommodating head 1, has an actuating tip 3 which, as it were, juts out from the sphere section 13 and in this case is designed as a cross-slot-type actuating tip. The latter engages in a corresponding cutout 27 on a fastening element 29, which in this case is formed by a screw provided with an external thread.

At its end which accommodates the accommodating head 1, the shank 7' has a smaller-diameter section onto which the sleeve 20 is plugged. The diameter of the section is selected such that the outer surface of the sleeve 20 plugged thereon is in alignment with the outer surface of the shank 7', that is to say, no disruptive offset formation or edge is produced.

The tool 2, retained in the accommodating head 1, can be pivoted about at least one pivot axis 31, which is arranged within the accommodating head 1, and, in the illustration according to FIG. 6, runs perpendicularly to the image plane. The pivot axis 31 here intersects the longitudinal center axis 33 of the shank 7' of the drive device 7. In this exemplary embodiment the longitudinal center axis 35 of the accommodating head 1 or of the output element 8 runs along the longitudinal center axis 33 of the shank 7'.

In the case of the tool illustrated in FIG. 6, the shank 7' is cylindrical and of rigid, that is to say, non-flexible design, which means that its longitudinal center axis 33 is a straight line. On account of its rigidity, the shank 7'—in contrast with the case of known actuating tools—is not bent or curved when the fastening element is screwed in and unscrewed.

In the illustration according to FIG. 6, the tool 2 is pivoted in a counterclockwise direction about the pivot axis 31 into a first pivot end position. The pivot axis 31 here runs through the center of the sphere section 13. A "pivot end position" is to be understood as meaning the position of the actuating tip 3 in which the latter is in the most extreme oblique position in relation to the accommodating head 1, or the longitudinal center axis thereof, and is prevented from pivoting further. The first pivot end position is defined in that the pivoting-angle-limiting projection 17 strikes against a surface of the sub-cutout 18. In the first pivot end position, the pivot axis 31, running within the accommodating head 1, is arranged at a distance x from the fastening element. According to the invention, with the actuating tip 3 plugged into the cutout 27, the distance x is very small, and this will be discussed in more detail hereinbelow. Since the pivot axis 31 is arranged very closely to the fastening element 29, the imaginary line of action 37 of an axial force F which is transmitted to the tool 2 via the drive device 7 when the fastening element 29 is screwed in and unscrewed, and is indicated by an arrow in FIG. 6, runs through the fastening element 29, in this case through the head of the screw. The axial force F is thus introduced into the fastening element 29 in each pivot position, that is to say even in the pivot end positions, which results in the actuating tip 3 being forced into the cutout 27 and thus being prevented from slipping out. In contrast to the case of the known accommodating heads or actuating tools, no tilting moment is thus produced, said tilting moment resulting in the tool 2 being forced out of the fastening element 29.

The distance x is measured between the pivot axis 31 and—with the actuating tip 3 plugged into the cutout 27 in the fastening element—the top edge of the fastening element 29, so in this case the head of the screw. When the actuating tip 3, as in the exemplary embodiment illustrated in FIG. 6, engages in its entirety in the cutout 27 in the fastening element 29, which may be possible whenever the depth of the cutout 27 is greater than the length of the actuating tip 3, the distance x corresponds to the distance between the cut surface 15/flattened portion of the polygonal-sphere section 13' and the pivot axis 31. With the actuating tip 3 plugged in its entirety into the cutout 27 in the fastening element 29, the cut surface 15 butts against the top side of the fastening element, in this case of the screw head, said top side having the cutout 27. In a preferred embodiment, the distance x is equal to or smaller than the radius of the sphere of the sphere section 13.

In the exemplary embodiment illustrated in FIG. 6, the imaginary line of action 37 intersects the fastening element 29 at point 39 which is located at a distance Y from the longitudinal center axis 41 of the fastening element 29. With correct handling of the tool, the distance Y is always smaller than half the diameter or half the width of the fastening element 29 in the region of its end which has the cutout 27 for the actuating tip 3. This ensures that the force which is applied by a user as the fastening element is screwed in or unscrewed, and acts in the axial direction of the actuating tool, is introduced into the fastening element in each pivot position of the actuating tip 3.

It can be seen clearly from FIG. 6 that it is critical for the distance x only to be very small, in order that the imaginary line of action 37 of the axial force F intersects the fastening element 29 even with the actuating tip 3 pivoted into its pivot end position. The distance x between the pivot axis 31 and the fastening element 29 may vary, depending on the embodiment of the actuating tip 3 or of the tool 2 and of the fastening element 29. Common to all the exemplary embodiments, however, is the fact that, in each case, the line of action of the axial force F intersects the fastening element 29 in each pivot position of the actuating tip 3.

It can readily be seen from FIG. 6 that the actuating tip 3 can be pivoted in the clockwise direction about the pivot axis 31 from the end position illustrated in FIG. 6 until the pivoting-angle-limiting projection 17 strikes against the opposite surface of the sub-cutout 18. This defines a second pivot end position of the actuating tip 3. The number of pivot end positions which the actuating tip can assume may correspond to the number of surfaces on the sphere section of the tool 2. The important factor is that the greater the angle range in which the actuating tip 3 can be pivoted about the pivot axis 31, the smaller the distance x has to be.

The tool 2 illustrated in FIG. 6 may be formed, for example, by a tool 2 illustrated in FIGS. 1 to 5. The mount for the tool is adapted or designed correspondingly in each case in order that a torque can be transmitted from the output element to the tool.

The accommodating head 1 according to the invention, or the actuating tool, in particular turning tool, which has the accommodating head 1, is particularly advantageous in tools 2 with an actuating tip 3 which does not have any surfaces which run parallel to the longitudinal center axis 41 of the fastening element 29 and can be utilized for the torque-transmission from the actuating tip 3 to the fastening element 29, for example, cross-slot-type actuating tips.

It has been found that in the case of tools mounted pivotably in an accommodating head, even if pivoting is necessary, the tool, rather than being pivoted only to a slight extent, is very frequently pivoted right into a pivot end position, in which the tool is positioned/supported against a stop. This may help improve the ease of turning for the user during handling of the actuating tool which has the accommodating head. The accommodating head 1 described with reference to FIG. 6 is thus advantageous since no tilting moment is produced even with the actuating tip pivoted into a pivot end position, it being possible for said tilting moment to result in the actuating tip being forced out of the cutout 27 in the fastening element 29. It is thus possible to ensure that the ease of turning is uniformly good in virtually any pivot position.

What is claimed is:

1. A rotary tool assembly with an actuating tip intended for turning, the tool assembly comprising:

a drive element;

a rotatable output element rotatable by the drive element around a longitudinal center axis;

a tool having an actuating tip for being connected with a driven element so that the driven element is driven by the tip, the tool being supported in the output element;

cooperating surfaces on the output element and the tool, the surfaces being profiled for supporting the tool to be rotationally fixed with the output element so that the tool rotates with the output element, and to be pivotable with respect to the output element permitting pivoting of the tool and its actuating tip to various pivot orientations with respect to the output element, the tool having an axis of pivot with respect to the output element;

tool pivoting stops in the output element to be contacted by the tool as it pivots for determining the extent of pivoting of the tool in the output element;

the tool being so shaped and the stops being so positioned in the output element that the distance between the pivot axis of the tool in the output element and the driven element when the actuating tip is at the driven element is short enough, with respect to the diameter of the driven element, that a line of action of force running along the longitudinal center axis of the output element intersects the driven element at all of the pivot orientations of the tool and the actuating tip with respect to the output element and with the tool being in pivot positions in or out of contact with the stops.

2. The tool assembly of claim 1, wherein the actuating tip is shaped for engaging and turning a rotatable fastening element having a cooperating element for receiving the actuating tip.

3. In combination the tool of claim 2 and a fastening element including a shank shaped fastening element having a head including means thereon adapted to receive the actuating tip of the tool, and the actuating tip of the tool being shaped to be received in the means in the head of the fastening element; the head of the fastening element being so sized that the line of action of force running along the longitudinal center axis of the output element intersects the head of the fastening element in every pivot position of the tool in the output element.

4. The tool of the claim 1 further comprising torque transmission means between the output element and the tool.

5. The tool of claim 1, wherein the tool has curved shaped surfaces where the tool engages the output element surfaces and the cooperating output element surfaces are shaped to rotationally fix the tool with respect to the output element while permitting pivoting of the tool in the output element.

6. The tool of claim 5, wherein the surfaces of the tool which engage the surfaces of the output element have a spherical section shape.

7. The tool of claim 6, wherein the surfaces of the tool comprise outer surfaces of the tool which comprise a plurality of generally flattened regions on the outer surfaces of the tool, and the cooperating surfaces in the output element comprise a cylindrical shaped sleeve with sections therein shaped cooperatively with the flattened regions on the surfaces of the tool, whereby the surfaces of the output element and the cooperating surfaces of the tool rotationally fix the tool in the output element while permitting pivoting of the tool with respect to the output element.

8. The tool of claim 7, wherein the sections of the tool surfaces are respective polygonal surfaces and the portion of the tool on which the polygonal surfaces are define is a polygonal sphere section.

9. The tool of claim 8, wherein the polygonal surfaces on the tool have an inward curvature.

10. The tool of claim 5, further comprising elements in the tool unit engaging the tool to retain the tool in the output element.

11. The tool of claim 10, further comprising elements in the tool unit preventing the tool from moving away from the driven element when the tool engages the driven element.

12. The tool of claim 5, wherein the actuating tip of the tool adjoins the rounded surfaces of the tool.

13. The tool of claim 1, further comprising a pivot angle restoring element connected with the tool for pivoting the pivot angle of the tool to a restored position from a pivoted position when forces are removed from the actuating tip that tend to pivot the tool with respect to the output element.

14. The tool of claim 13, further comprising stops for determining the extent of pivoting of the tool in the output element.

15. The tool of claim 1, further comprising a pivot angle restoring element connected with the tool for restoring the pivot angle of the tool to a restored position from a pivoted position when forces that tend to pivot the tool with respect to the output element are removed from the actuating tip.

16. The tool of claim 15, further comprising a pivot angle limiting projection on the tool and wherein the pivot angle restoring element comprises an elastic element extending between the pivot angle limiting projection on the tool and elements associated with the output element.

17. The tool of claim 1, wherein the drive to the output element comprises a shank mount for receiving a shank from a drive device.

18. The tool of claim 17, wherein the shank mount and the shank are fixed to one another.

19. The tool of claim 18, wherein the shank mount comprises a plug connection mount for accommodating the shank of the drive device in a releaseable manner.

20. The tool of claim 19, wherein the output element for the tool and the shank mount are formed in a common sleeve.

21. The tool of claim 20, wherein the common sleeve has a through passage with surfaces of a polygonal cross-section and the surfaces define the surfaces of the output element.

22. The tool of claim 16, further comprising the shank of the drive device having a cutout extending in the axial direction of the shank and the projection on the tool extending into the cutout for engaging the surfaces of the cutout for defining the maximum pivoting of the tool in the output element.

23. The tool of claim 12, wherein the curved portions of the tool terminate in a flattened side of the tool above the actuating tip and the actuating tip projects from the flattened side of the tool.

24. The tool of claim 5, wherein the curved surfaces of the tool, the output element surfaces and the drive element are all so shaped that the curved surfaces of the tool are generally entirely enclosed within the output element so that only the actuating tip projects out of the output element.

25. The tool of claim 5, wherein the distance between the pivot axis of the tool and the portion of the fastening element to which the line of force extends is equal to or smaller than the radius of the curved shaped surfaces of the tool.

* * * * *